US005424031A

United States Patent [19]

Arnberg et al.

[11] Patent Number: 5,424,031

[45] Date of Patent: Jun. 13, 1995

[54] GRAIN REFINING ALLOY AND A METHOD FOR GRAIN REFINING OF ALUMINUM AND ALUMINUM ALLOYS

[75] Inventors: Lars Arnberg, Trondheim; Gunnar Halvorsen, Kristiansand; Per Arne Tondel, Trondheim, all of Norway

[73] Assignee: Elkem Aluminium ANS, Norway

[21] Appl. No.: 108,825

[22] Filed: Aug. 18, 1993

Related U.S. Application Data

[63] Continuation of Ser. No. 858,118, Mar. 26, 1992, abandoned.

[30] Foreign Application Priority Data

Jan. 8, 1992 [NO] Norway ..... 920095

[51] Int. Cl.[6] ..... C22C 21/00

[52] U.S. Cl. ..... 420/528; 75/375; 75/684; 420/578; 420/590; 423/349

[58] Field of Search ..... 75/375, 254, 304, 307, 75/684; 420/528, 578, 590; 423/348, 349, 350

[56] References Cited

U.S. PATENT DOCUMENTS

| | | | |
|---|---|---|---|
| 2,885,286 | 5/1959 | Weber | 420/533 |
| 3,503,738 | 3/1970 | Cooper | 420/528 |
| 3,592,391 | 7/1971 | Bender | 75/0.5 R |
| 3,849,123 | 11/1974 | Webster | 420/552 |
| 4,298,423 | 11/1981 | Lindmayer | 423/348 |
| 4,347,199 | 8/1982 | Speier et al. | 264/8 |
| 4,419,060 | 12/1983 | Speier et al. | 425/8 |
| 4,595,559 | 6/1986 | Planchamp | 420/528 |
| 4,828,814 | 5/1989 | Sanjurjo et al. | 423/348 |
| 5,066,324 | 11/1991 | Perepezko et al. | 75/375 |
| 5,094,832 | 3/1992 | Forwald et al. | 423/349 |
| 5,128,116 | 7/1992 | Forwald et al. | 423/348 |

FOREIGN PATENT DOCUMENTS

| | | |
|---|---|---|
| 0069026 | 1/1983 | European Pat. Off. . |
| 0372918 | 6/1990 | European Pat. Off. . |
| 74111 | 6/1970 | German Dem. Rep. . |
| 2221295 | 11/1973 | Germany . |
| 47-18406 | 5/1972 | Japan . |
| 57-174428 | 10/1982 | Japan . |
| 2162540 | 2/1986 | United Kingdom . |
| 2174103 | 10/1986 | United Kingdom . |

OTHER PUBLICATIONS

Trans. of AFS, vol. 93, 29 Apr. 1985, Des Plaines, Ill., pp. 907–912, Sigworth et al. "Grain refining of Hypereutectic Al–Si Alloys".

Met. Trans., vol. 2, No. 2, Feb. 1971, pp. 465–471, Marcantonio et al. "Grain Refinement in Aluminum Alloyed with Titanium and Boron".

Thistlewaite et al. "Light Metals, Practical and Technical Considerations for Selection of Grain Refining Alloys in the Cast House", pp. 1169–1178, 1985, Aime, Warrendale, Pa.

Massalski, T. B. et al., ed., Binary Alloy Phase Diagrams vol. 1, ASM Ohio 1986, pp. 384–385.

Himmelblau, "Basic Principles & Calc. in Che. Eng." 4th Ed., Prentice–Hall, Inc. New Jersey p. 154.

Perry et al., "Perry's Chem. Eng. Handbook" 6th Ed., McGraw–Hill Book Co., N.Y., pp. 6–109, 20–77.

Peters et al., "Plant Design & Economics for Che. Eng." 3rd Ed., McGraw–Hill Book Co., N.Y., pp. 33–34, 67.

*Primary Examiner*—Melvyn J. Andrews
*Assistant Examiner*—Robert R. Koehler
*Attorney, Agent, or Firm*—Lucas & Just

[57] ABSTRACT

The present invention relates to a method for grain refining of aluminium and aluminium alloys wherein a siliconboron alloy containing between 0.01 to 4.0% by weight of boron is added to molten aluminium or aluminium alloy in such an amount that the resulting melt of aluminium or aluminium alloy contains at least 50 ppm boron. The invention further relates to a grain refining alloy for aluminium and aluminium alloys which grain refining alloy is a siliconboron alloy containing between 0.01 and 4.0% by weight of boron.

18 Claims, 2 Drawing Sheets

Figure 1:
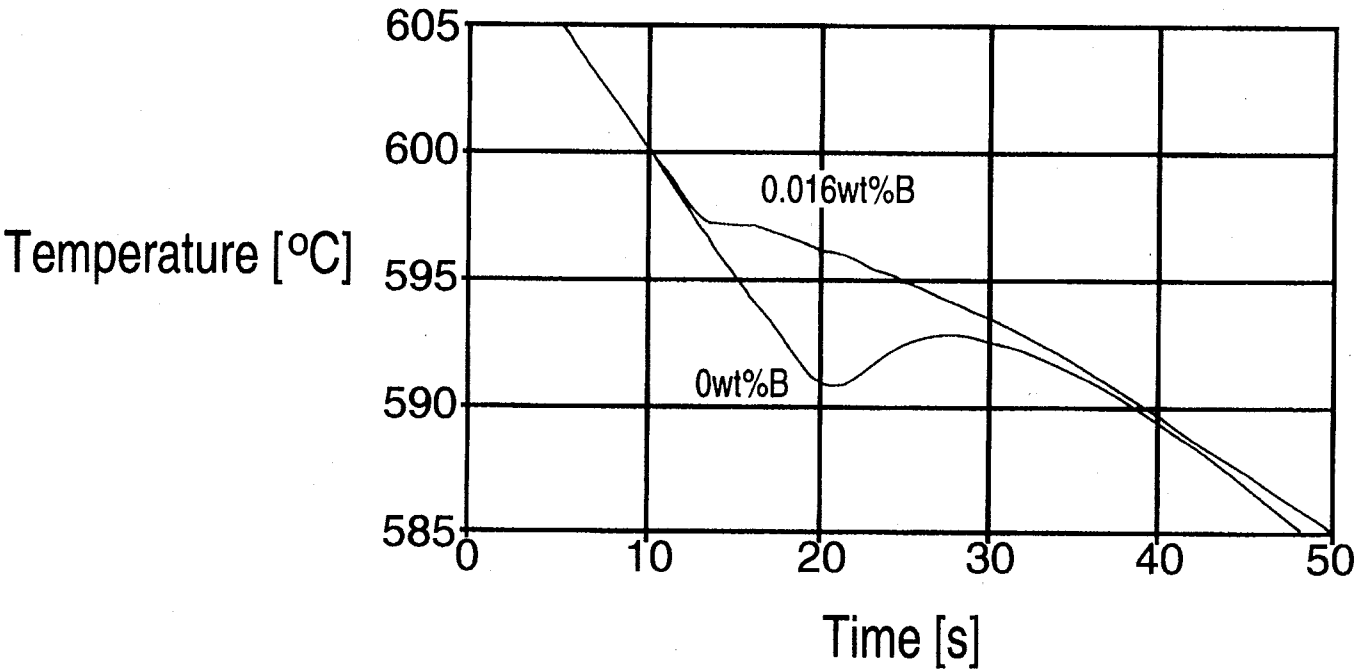

GRAIN REFINING ALLOY AND A METHOD FOR GRAIN REFINING OF ALUMINUM AND ALUMINUM ALLOYS

This is a continuation of application Ser. No. 07/858,118, filed Mar. 26, 1992, now abandoned.

The present invention relates to a method for grain refining of aluminium and aluminium alloys and to a grain refining alloy for carrying out the method.

The grain structure of a metal or an alloy decides a number of important properties in the product. Grain refining of aluminium and aluminium based alloys is an example of how a structure consisting of small equiaxial grains gives a number of advantages compared to a structure comprising larger grains. The most important are:

—Improved castability due to more efficient flow of metal.

—Improved mechanical properties.

—Improved machinability.

—Improved surface quality.

The grain size is varies with the chemical composition of the alloy and with the casting method. The casting method decides a number of important factors, such as cooling rate, casting temperature, temperature gradient and the state of mixture in the melt both before and during solidification.

It is not always possible to control or optimize these factors and it has therefore been found necessary to add grain refiners to the molten metal prior to casting. Addition of grain refiners "catalyzes" the nucleation of aluminium crystals. Commercially available grain refiners contain, in addition to aluminium, titanium and/or boron. By changing the composition of grain refining alloys one can obtain big differences in their ability to effect grain refining.

The concept of grain refining can be divided into two phenomena; nucleation and growth of crystals to a limited size. The grain refining alloys contain aluminium with titanium and/or boron in solid solution and particles like $TiAl_3$ and/or $TiB_2/AlB_2$. It is generally accepted that grain refining is due to heterogeneous nucleation of aluminium crystals on particles supplied through the grain refining alloy. It is, however, not known if the active particles are $TiAl_3$ or $TiB_2$.

The above described method for grain refining has, however, the disadvantage of incubation time and the so-called fading effect. Incubation time means that the molten aluminium must be kept in molten state for some time after addition of the gain refiner in order to obtain optimum effect, while the fading effect means that the grain refining effect decreases with the holding time. It is believed that the fading effect is caused by particles settling in the melt. A serious problem with grain refining of aluminium alloys which are to be used for rolling products is agglomeration of $TiB_2$-particles, so-called clustering, which can cause holes in the foil. In addition inhomogeneous grain structures have been observed, both in regard to gain size and crystal structure.

By the present invention a method for grain refining has been found whereby aluminium and aluminium alloys with a very small gain size are obtained and whereby the problem of fading has been substantially reduced.

According to a first aspect the present invention relates to a method for grain refining of aluminium and aluminium alloys wherein a siliconboron alloy containing from 0.01 to 4.0% by weight of boron is added to molten aluminium or aluminium alloy in such an amount that the resulting melt of aluminium or aluminium alloy contains at least 50 ppm boron.

According to a preferred embodiment of the method, a siliconboron alloy containing between 0.02 and 1% by weight of boron is added to the molten aluminium or aluminium alloy. The siliconboron alloy is preferably added in such an amount that the resulting melt of aluminium or aluminium alloy contains at least 100 ppm boron.

According to a second aspect the present invention relates to a grain refining alloy for aluminium and aluminium alloys, which grain refining alloy is a siliconboron alloy containing between 0.01 and 4% by weight of boron.

According to a preferred embodiment the siliconboron alloy contains between 0.02 and 1.0% by weight of boron.

The gain refining alloy according to the present invention may contain up to 1% by weight of iron and up to 2% by weight of aluminium without substantially affecting the grain refining effect. The iron content is preferably below 0.5% by weight and more preferably below 0.2% by weight while the aluminium content preferably is below 1% by weight and more preferably below 0.5% by weight.

It has surprisingly been found that the method and the grain refining alloy according to the present invention results in very small grains at a very low boron content in aluminium and aluminium alloys at the same time as the known fading effect virtually does not exist.

It is believed that the surprisingly good effect of the grain refining alloy according to the present invention is due to the fact that the mechanism of the grain refining by the method of the present invention is different from the mechanism which is effective when using known grain refiners consisting of aluminium with titanium and/or boron. While the grain refining effect of these known grain refiners as mentioned above is believed to be caused by presence of particles of the type $TiAl_3$ and/or $TiB_2/AlB_2$ in the grain refiners which are added to the aluminium melt and which particles cause nucleation in the melt, it has been found that by the grain refiner and the method according to the present invention, the addition of siliconboron alloy causes solution of boron atoms in the aluminium melt. First by cooling the aluminium melt, $AlB_2$ particles are formed in situ in the melt. The $AlB_2$ particles have a lower density than $TiB_2$ and $TiAl_3$ particles and have therefore a lower tendency of settling in the aluminium melt. This can explain the fact that the well known fading effect, even after long holding times, does not occur by the method of the present invention.

By the method of the present invention aluminium alloys having extremely small equiaxial grains have been obtained. Thus for an AlSi-alloy containing 9.6% by weight of Si grain sizes of 200–300 μm have been obtained at a boron content in the melt of 160 ppm. By grain refining of the same alloy using a conventional aluminium based grain refining alloy containing 6% by weight of titanium, grain sizes of about 1800 μm at a Ti-content of 0.10% by weight and about 1300 μm at a Ti-content of 0.2% by weight were obtained.

As the grain refining alloy according to the present invention contains silicon as the dominating component the method of the present invention cannot be used for aluminium and aluminium alloys where the silicon content shall be very low. The grain refining alloy according to the present invention can thus in practice not be used for aluminium and aluminium alloys which after grain refining shall contain less than 0.1% by weight of silicon.

EXAMPLE 1

A number of 3 kg high purity aluminium specimens were placed in salamander crucibles and melted in a resistance furnace. The furnace temperature was kept constant at 800° C. To four of the aluminium melts there was thereafter added a siliconboron alloy containing about 1% by weight of boron in solid solution, in such an amount that the final alloys contained about 9.6% by weight of Si and had boron contents of 110 ppm, 160 ppm, 550 ppm and 680 ppm respectively.

For comparison purpose there was provided a melt of 3 kg high purity aluminium which was alloyed with high purity silicon to provide an alloy containing about 9.6% by weight of silicon. The high purity silicon used did not contain boron.

The melts were cast at a constant cooling rate of 1° C. per second and the nucleation temperature and the growth temperature for the aluminium crystals were calculated from the cooling curves.

The grain sizes for the cast specimens were measured according to the intercept method (D(TA)). In addition the grain sizes were measured according to Aluminium Associations: "Standard Test Procedure for Aluminium Grain Refiners" (D(AA)). According to this standard the cooling rate is about 5° C. per second.

Figure 2:
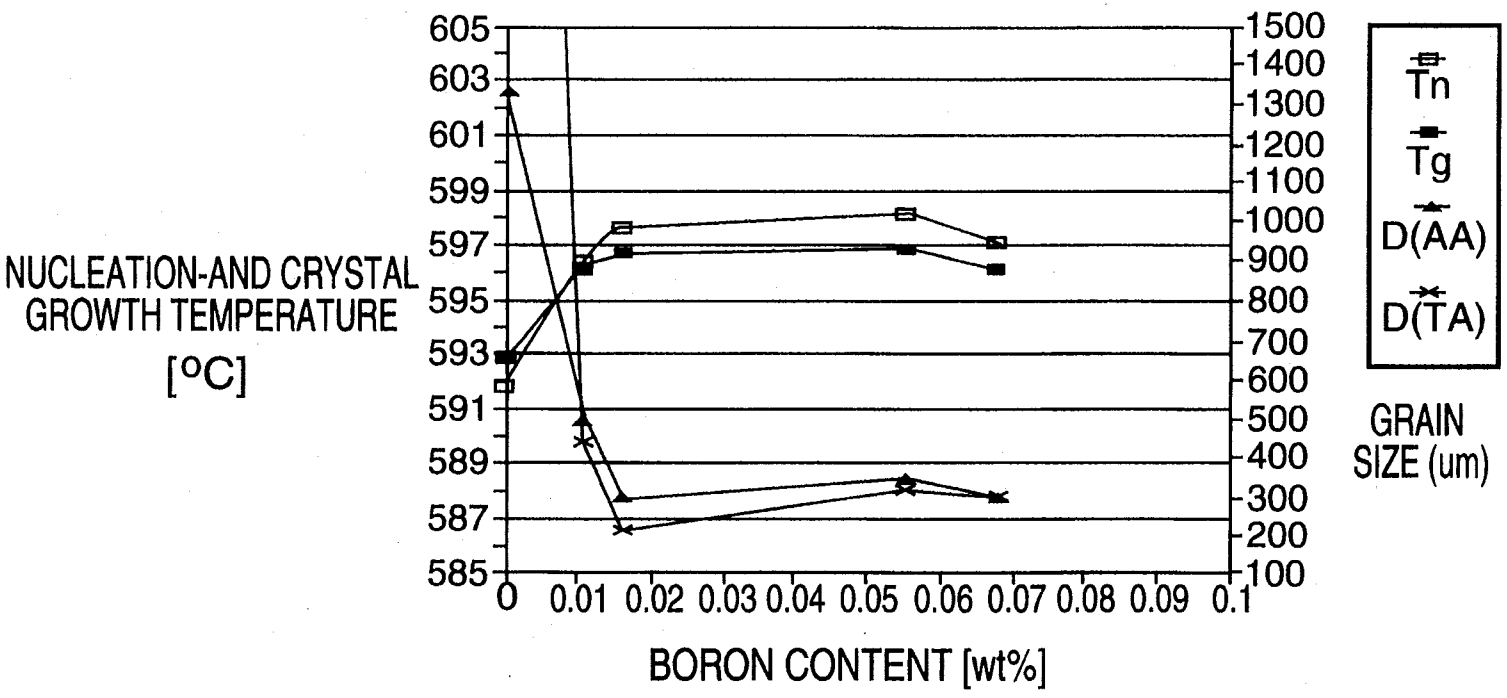

The results are shown in FIG. 1 and 2 where FIG. 1 shows the cooling curves for the melt containing 160 ppm boron and for the melt that did not contain boron, and where FIG. 2 shows the nucleation temperature, Tn, the crystal growth temperature, Tg, and the grain size as a function of boron content in the aluminium alloys.

From FIG. 1 it can be seen that the start of the solidification process is very different for the alloy which was treated by the method of the present invention compared to the Al-Si alloy without boron addition. Thus the Al-Si alloy without boron addition shows a supercooling before recalescence up to the crystal growth temperature. In contrast to this the cooling curve for the alloy which was grain refined according to the present invention flattens out at a substantially constant temperature level immediately after nucleation.

From FIG. 2 it can be seen that for the specimens containing boron, the nucleation temperature and crystal growth temperature seem to be independant of the boron concentration above a certain minimum value. FIG. 2 further shows that the grain sizes that are obtained by addition of the grain refiner according to the present invention are very small and in the range of 300 μm. It can further be seen from FIG. 2 that the grain size is independent of the boron content as long as the boron content is kept above a certain mimimum value. Finally FIG. 2 shows that the cooling rate does not substantially affect the grain size for the aluminium alloys which have been grain refined according to the present invention.

In order to investigate the fading effect, additional melts of the above mentioned compositions were cast 1 hour, 2 hours, 2.5 hours, 3.4 hours, 4 hours and 6.5 hours after addition of grain refiner. It was found that the nucleation and crystal growth temperature were not affected by the holding time. This shows that the fading effect does not occur by use of the grain refiner according to the present invention.

EXAMPLE 2

Two melts of 3 kg high purity aiuminium were produced in the same way as described in Example 1. A siliconboron alloy containing about 1% by weight of boron was added to the two melts in such an amount that the final alloys contained 1.1% by weight of silicon and 100 ppm boron. The melts were kept at 800° C. for 0.5 and 1 hour respectively, whereafter the alloys were cast at a cooling rate of 1° C. per second. The cooling curves for the two alloys show that the supercooling before formation of aluminium crystals was about 0.5° C. which is substantially less than what is expected for such an alloy without boron content. This shows that the method and the grain refiner according to the present invention are also effective for aluminium having a relatively low silicon content. The grain sizes for the solidified specimens were measured according to the intercept method. The average grain size was measured to about 900 μm which is substantially less than what is expected for an Al-1.1Si alloy which has not been grain refined.

Microstructure investigation of the two specimens showed that a number of the aluminium crystals contained primary $AlB_2$ particle in their center.

What is claimed is:

1. A method for grain refining of aluminum or aluminum alloys with a grain refining alloy which substantially reduces the fading effect of the grain refining alloy, and which produces a small equiaxial grain size in aluminum or aluminum alloys, said method comprising the steps of:

(a) adding a grain refining alloy which is a silicon boron alloy to a melt of aluminum or aluminum alloys in an amount such that said melt contains at least about 50 ppm boron, said silicon boron alloy comprising about 0.01 to about 4.0% by weight boron, up to about 2% by weight aluminum, up to about 1% by weight iron and a balance of silicon; and (b) cooling said melt to form a solid aluminum or aluminum alloy having a small equiaxial grain size and wherein said grain refining alloy does not fade after 4 hours of hold time prior to cooling and forming said solid.

2. The method of claim wherein said silicon boron alloy contains about 0.02 to 1% by weight boron.

3. The method of claim 1 wherein said silicon boron alloy is added to said melt to provide said melt with at least about 100 ppm of boron.

4. The method of claim 2 wherein said silicon boron alloy is added to said melt to provide said melt with at least about 100 ppm of boron.

5. The method of claim 4 wherein said silicon boron alloy contains below about 1% by weight aluminum, and below about 0.5% by weight iron.

6. The method of claim 5 wherein said silicon boron alloy contains below about 0.5% by weight aluminum and below about 0.2% by weight iron.

7. A method for grain refining of aluminum or aluminum alloys with a grain refining alloy which substantially reduces the fading effect of the grain refining alloy and which produces a small equiaxial grain size of aluminum or aluminum alloy, said method comprising the steps of:

(a) adding a grain refining alloy which is a silicon boron alloy to a melt of aluminum or aluminum alloys in an amount such that said melt contains at least about 50 ppm of boron, said silicon boron alloy consisting essentially of about 0.01 to about 4.0% by weight boron, up to about 2% by weight aluminum, up to about 1% by weight iron and a balance of silicon; and (b) cooling said melt to form a solid aluminum or aluminum alloy having a small equiaxial grain size and wherein said grain refining alloy does not fade after 4 hours of hold time prior to cooling and forming said solid.

8. The method of claim 7 wherein said silicon boron alloy contains about 0.02 to 1% by weight boron.

9. The method of claim 7 wherein said silicon boron alloy is added to said melt to provide said melt with at least about 100 ppm of boron.

10. The method of claim 8 wherein said silicon boron alloy is added to said melt to provide said melt with at least about 100 ppm of boron.

11. The method of claim 10 wherein said silicon boron alloy contains below about 1% by weight aluminum, and below about 0.5% by weight iron.

12. The method of claim 11 wherein said silicon boron alloy contains below about 0.5% by weight aluminum, and below about 0.2% by weight iron.

13. A method for grain refining of aluminum or aluminum alloys with a grain refining alloy which substantially reduces the fading effect of the grain refining alloy, and which produces a small equiaxial grain size in aluminum or aluminum alloy, said method comprising the steps of:

(a) adding a grain refining alloy which is a silicon boron alloy to a melt of aluminum or aluminum alloys in an amount such that said melt contains at least about 50 ppm boron, said silicon boron alloy consisting of about 0.01 to about 4.0% by weight boron, up to about 2% by weight aluminum, up to about 1% by weight iron and a balance of silicon; and (b) cooling said melt to form a solid aluminum or aluminum alloy having a small equiaxial grain size and wherein said grain refining alloy does not fade after 4 hours of hold time prior to cooling and forming said solid.

14. The method of claim 13 wherein said silicon boron alloy contains about 0.02 to 1% by weight boron.

15. The method of claim 13 wherein said silicon boron alloy is added to said melt to provide said melt with at least about 100 ppm of boron.

16. The method of claim 14 wherein said silicon boron alloy is added to said melt to provide said melt with at least about 100 ppm of boron.

17. The method of claim 16 wherein said silicon boron alloy contains below about 1% by weight aluminum, and below about 0.5% by weight iron.

18. The method of claim 17 wherein said silicon boron alloy contains below about 0.5% by weight aluminum, and below about 0.2% by weight iron.

* * * * *

UNITED STATES PATENT AND TRADEMARK OFFICE

CERTIFICATE OF CORRECTION

PATENT NO. : 5,424,031

DATED : June 13, 1995

INVENTOR(S) : Lars Arnberg et al.

It is certified that error appears in the above-indentified patent and that said Letters Patent is hereby corrected as shown below:

Column 1, line 23, delete "is";

Column 1, line 51, change "gain" to --grain--.

Column 1, line 60, change "gain" to --grain--.

Column 1, line 63, change "gain" to --grain--.

Column 2, line 20, change "gain" to --grain--.

Column 4, line 47 (claim 2), after "claim" insert --1--.

Signed and Sealed this

Twelfth Day of September, 1995

*Attest:*

Bruce Lehman

BRUCE LEHMAN

*Attesting Officer*

*Commissioner of Patents and Trademarks*